United States Patent [19]

Fletcher, Jr.

[11] Patent Number: 4,995,510

[45] Date of Patent: Feb. 26, 1991

[54] CLUB-SEPARATING INSERT SYSTEM FOR GOLF BAGS

[76] Inventor: Carl C. Fletcher, Jr., 717 Winding Way, Bartlesville, Okla. 74006

[21] Appl. No.: 714,479

[22] Filed: Mar. 21, 1985

[51] Int. Cl.[5] ..... A63B 35/00

[52] U.S. Cl. ..... 206/315.6; 206/315.3

[58] Field of Search ..... 206/315.2, 315.3, 315.5, 206/315.6

[56] References Cited

U.S. PATENT DOCUMENTS

| | | | |
|---|---|---|---|
| 1,417,380 | 5/1922 | Hatch | 206/315.6 |
| 1,731,588 | 10/1929 | Patterson | 206/315.6 |
| 1,849,610 | 3/1932 | Boyce | 206/315.6 |
| 2,128,546 | 8/1938 | Venmore | 206/315.6 X |
| 2,722,258 | 11/1955 | Smidt et al. | 206/315.6 |
| 2,781,072 | 2/1957 | Kouke | 206/315.6 |
| 3,534,795 | 10/1970 | Wiedenmeier | 206/315.6 |
| 3,554,255 | 1/1971 | Mangan | 206/315.6 |
| 3,996,983 | 12/1976 | Isnardi | 206/315.6 |
| 4,055,207 | 10/1977 | Goodwin | 206/315.6 |
| 4,172,484 | 10/1979 | Henning | 206/315.6 |
| 4,194,547 | 3/1980 | Sidor et al. | 206/315.6 |
| 4,200,131 | 4/1980 | Chitwood et al. | 206/315.6 |
| 4,340,102 | 7/1982 | Isabel | 206/315.6 |

*Primary Examiner*—Sue A. Weaver

*Attorney, Agent, or Firm*—James K. Poole

[57] ABSTRACT

A process of designing and producing a club-separating insert system for a golf bag to arrange a set of golf clubs in a pattern of groups convenient for normal play and to provide maximum lateral and vertical separation for the club heads within the space available provides a system comprising at least one insert having apertures spaced at intervals within groups to receive the handles and shafts of the golf clubs, at least some of these intervals being non-uniform.

7 Claims, 2 Drawing Sheets

| LEGEND |
| --- |
| 1W = NUMBER 1 WOOD, ETC. |
| 2I = NUMBER 2 IRON, ETC. |
| SW = SAND WEDGE |
| PW = PITCHING WEDGE |
| PUT = PUTTER |

CLUB-SEPARATING INSERT SYSTEM FOR GOLF BAGS

BACKGROUND OF THE INVENTION

1. Field of the Invention

The present invention relates to golf accessories for golf bags and clubs, and more particularly, to a club-separating insert system for golf bags.

2. Description of the Prior Art

Many golfers have large sums of money invested in their golf clubs and endeavor to keep them well protected while in play as well as in storage and for travel. Club head covers and elongated plastic tubes are available to protect golf clubs when placed in a golf bag and provide a limited amount of protection. Various systems of dividers and club holders have been proposed to segregate golf clubs or the protective tubes for the shafts of the golf clubs in the bag. These systems typically provide spaces for clubs laid out in simple geometric arrangements with equal spacings regardless of the sizes or patterns of movement of the club heads, and therefore make inefficient use of the lateral space in a golf bag within which clubs may be arranged for optimum protection and convenience of use.

For example, U.S. Pat. No. 3,996,983 discloses a club holder for golf bags comprising a single flat plate having a plurality of apertures which are arranged in rows or arcs along the periphery of the plate, the apertures being equally spaced in each row or arc. The plate illustrated is circular to match the cross-section of the golf bag.

U.S. Pat. No. 2,781,072 discloses a club rack insert for golf bags comprising a pair of complementary plates formed with corresponding arrangements of club supporting apertures and a series of parallel rods extending between the plates to provide a light but rigid assembly to support the golf clubs and provide rigidity to the golf bag. The plates disclosed are roughly trapezoidal in shape to match the cross-section of the golf bag illustrated, and the apertures are arranged in several rows, being equally spaced in each row.

U.S. Pat. No. 4,200,131 discloses a device for carrying and transporting golf clubs in a golf bag which includes an upper plate having a plurality of apertures for the golf clubs and receiving surfaces against which the golf club irons can be secured, a smaller lower plate installed at the bottom of the golf bag to receive the ends of the shafts, and a series of tubes connecting the apertures of the upper and lower plates through which the handles and shafts of the golf clubs are passed. The upper plate is roughly trapezoidal in shape, conforming to the contours of the golf bag, and the apertures and receiving surfaces for the irons are arranged in two rows, with the apertures equally spaced therein. Apertures for the woods are in a separate row, being equally spaced therein, and preferably spaced far enough apart to avoid contact of the wood heads with each other, according to the patent.

Although many systems have been proposed over the years for separating and arranging golf clubs to provide protection from inter-club contact while the bag is in use on the golf course and to arrange the clubs suitably for convenience of play, the search continues for a system which will provide a convenient arrangement for play while optimizing the protection available to the clubs within the space constraints of the typical golf bag. For instance, with most systems disclosed or available currently, the wood clubs are spaced so closely together that the heads can contact each other during normal transport of the bag about the golf course, and therefore club head covers must be kept on the woods when they are not actually in play to prevent marring.

Since existing systems for separating golf clubs within golf bags seem to be "all purpose" systems for accommodating golf clubs in any desired pattern, the apertures for the clubs are generally evenly spaced within groups intended for various clubs, and use the lateral space available in a golf bag ineffectively.

OBJECTS OF THE INVENTION

It is a primary object of the present invention to solve some of the problems described above by providing a club-separating insert system for golf bags which segregates golf clubs in the bag, providing the maximum separation permitted by the space constraints of the bag to prevent damage to the clubs from inter-club contact while the bag is transported about the course during play.

A primary object of the present invention is to provide a process for designing club-separating insert systems for golf bags to provide the maximum effective separation between the clubs of a given set when arranged in a golf bag of given size and shape, for instance bags of essentially circular or rectangular cross-section.

A further object is to provide a club-separating insert system which can be designed to fit golf bags of various cross-sectional shapes and sizes and accommodate various standard and non-standard sets of golf clubs when installed therein, either permanently or non-permanently.

Another object is to provide a club-separating insert system which arranges golf clubs in a bag within groups in a pattern convenient for normal play, preferably in a pattern which is readily recognizable by the user.

These objects, as well as further objects and advantages of the present invention, will become readily apparent after reading the following description of non-limiting illustrative embodiments, the accompanying drawings and the appended claims.

SUMMARY OF THE INVENTION

In accordance with the invention, a process is provided for designing club-separating insert systems for golf bags to arrange, segregate and secure a set of golf clubs in a pattern of groups convenient for normal play, and to provide the maximum effective clearance, i.e. lateral and vertical spacing, for the clubs within the space available in the bag, comprising the steps of (a) projecting the plan view contour of each club head onto a horizontal plane and determining the locus of rotational movement of each club head in a lateral plane when the club handle is inserted in an aperture in the club-separating insert system, (b) determining the vertical height of each club head from the end of the handle, and (c) arranging the apertures in at least one insert of the insert system for the various groups of clubs, the apertures being positioned in groups and spaced within each group at intervals, at least some of which are non-uniform, to maximize the effective clearance, encompassing both lateral and vertical separations, between the club heads while the golf bag is in use, when their loci of rotational movement and height are considered.

Further in accordance with the invention, a club-separating insert system designed in accordance with this process is provided, comprising at least one insert containing apertures for the golf club shafts and located near the top of the golf bag. Preferably, the system comprises at least one additional insert located at or near the bottom of the golf bag, and a series of protective tubes for receiving the golf club shafts, which fit into the corresponding apertures of the inserts, providing a rigid structure.

Further in accordance with the invention, an embodiment is provided which comprises a club-separating insert system for bags of substantially circular cross-section, comprising an upper circular insert to fit inside the top of the golf bag, and having a series of apertures arranged for the storage of golf clubs in a pattern of groups convenient for normal play and spaced within these groups at intervals, at least some of which are nonuniform, to maximize the lateral and vertical separation between the heads of the clubs.

Still further in accordance with the invention, another embodiment provides a club-separating insert system for a golf bag of substantially rectangular cross-section, comprising an upper insert of rectangular cross-section to fit inside the top of the bag and having a series of apertures arranged for the storage of the clubs in a pattern of groups convenient for normal play and spaced within these groups at intervals, at least some of which are non-uniform, to maximize the lateral and vertical separation between the heads of the clubs.

BRIEF DESCRIPTION OF THE DRAWINGS

In order that the present invention may be more fully understood, it will be described by way of example, with reference to the accompanying drawings in which.

DETAILED DESCRIPTION OF THE INVENTION

The present invention provides a process for designing club-separating insert systems which can provide secure separation and convenient arrangements for a standard set of 14 golf clubs, and also for larger or smaller sets of clubs.

In accordance with the invention, to maximize the effective clearance which can be obtained between the club heads, the lengths of the clubs are considered as well as the size and loci of movement of the heads of the clubs while the bag is at rest or in motion on the golf course. Thus, clubs can be conveniently grouped by both length and function, and the apertures for shorter clubs can conveniently be placed closer to the apertures for the longer clubs without contact taking place between the club heads. Since clubs differ in head size and length within each set and among sets produced by various manufacturers, variable or non-uniform spacing for the apertures intended to accommodate the clubs makes more effective use of the lateral space available within a given bag, thus providing maximum effective clearance between the club heads and a convenient arrangement for play.

The best results are obtained by designing a system to accommodate a particular set of golf clubs to a particular size and shape bag, arranging the apertures in groups of similar clubs to provide for convenient usage and optimum separation of the club heads. However, systems can be designed to accommodate most standard sets of golf clubs in a golf bag of any specific size and shape, with the apertures grouped to accommodate clubs in general categories as discussed above, i.e., woods, long irons, mid-irons, and short irons These groups correspond generally to various phases of play, including driving, fairway shots, approach shots, chipping and putting. If a system is designed to accommodate a set of golf clubs having relatively large heads, such as clubs manufactured by the "Ping" Company, generally most other standard sets of golf clubs can be accommodated without contact between the club heads.

A design objective is that each golf club should avoid contact with other club heads when the bag is a vertical position or a slanted non-vertical position as when mounted in a hand cart or motorized golf cart. This avoids damage to the club heads as they execute minor vertical or rotational movements while the golf bag is transported about the course, and also provide that any club can be easily removed from the bag without interfering with or moving another club. When the golf clubs are suitably spaced and secured in position, protective covers for both wood and iron clubs can be removed from the clubs at the beginning of the round of golf without fear of damage, eliminating the necessity of removing and replacing such protective covers during play.

A suitable arrangement for variably or non-uniformly spaced apertures to accommodate golf clubs from various groups of a typical set can be determined by the following hand technique.

Figure 1:
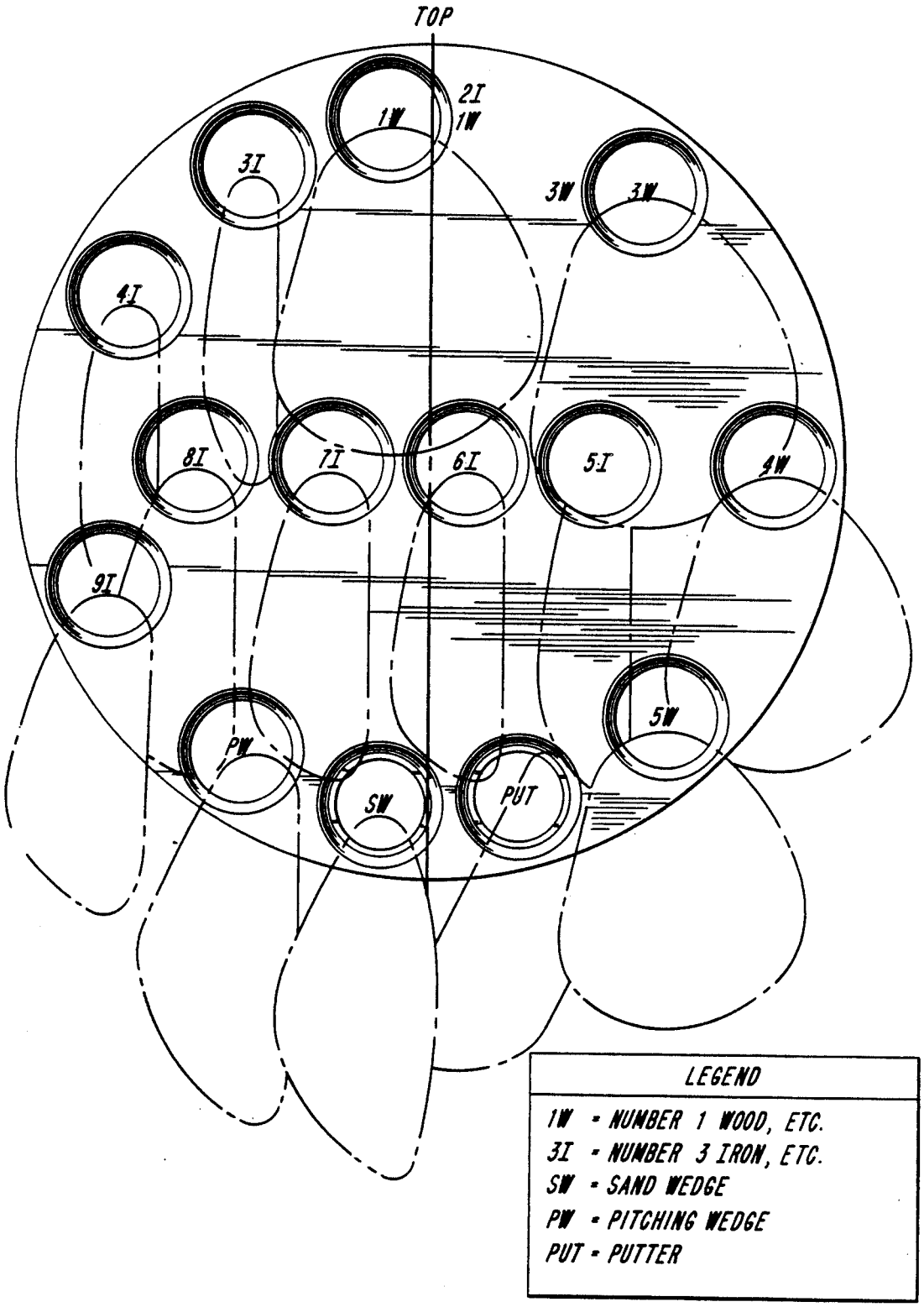
FIG. 1 is a top plan view of a preferred embodiment of the present invention as applied to a golf bag of round cross-section.

First, each golf club is suspended vertically above a flat, horizontal writing surface and a projected plan view of the contour or periphery of the club head is sketched upon the writing surface, noting the location of the shaft. Since the apertures in the plate must be large enough to accommodate the handle of the golf club, which is larger than the shaft portion near the head, when the bag is tilted from the vertical the club shafts will rest on the low side of the aperture through which the shaft passes, as shown in FIG. 1. The shaft of each club is laid upon a flat surface such as a table or work bench with the club head overhanging the edge so that the normal hanging position of the club head can be observed. An appropriate vertical line is marked upon the corresponding projected plan view of each club head. Then the appropriate aperture is marked on the club head plan view, considering the club shaft at the low point of the aperture while the bag is tilted. The resulting plan views of club heads and apertures are cut out for use as templates in determining the optimum arrangement of apertures for each group of clubs. Because these plan views were developed from a downward projection, the cutout templates are reversed or turned upside down to provide the appropriate view of the club in the bag.

Using a set of templates corresponding to the set of clubs to be accommodated in a given bag, the templates are arranged on a pattern representing a cross-section of the bag to be used, arranging the clubs in suitable groups for convenience of play and with sufficient space within each group and between the groups to eliminate contact between the club heads, considering the positions of the club heads both at rest and expected during normal rotational motion during movement of the bag. The expected maximum rotational motion can be estimated as less than 10 degrees of arc in either direction, or preferably less than about 5 degrees of arc in either direction. Since the clubs will generally rotate in the same direction while the bag is in motion, actual overlap of the club heads during their movements is expected to be minimal. Once an appropriate arrangement is determined, positions are marked for the resting points of the golf club shafts at the low points of the apertures, and thereafter the center points for the drilling of the apertures in a pattern for production of the inserts. Generally, the groups of clubs will be separated by intervals between the nearest apertures of less than the length of any of the club heads, and preferably greater than half such a dimension. The apertures are spaced within groups at intervals, at least some of which are non-uniform, ranging from minimal to about twice the diameter of a golf club handle grip. Preferably, a majority of the intervals are non-uniform, so as to space the golf clubs in a pattern which provides the maximum effective clearance between clubs for the lateral space available within a given bag.

Since the wood clubs have the longest shafts and largest club heads, these clubs are preferably located on the upper right hand side of the golf bag, viewing the golf bag in plan view from the side which is normally attached to a golf cart. Such positioning allows significant portions of these club heads to hang outside the golf bag, thus minimizing interference with other club heads. This pattern, of course, is determined for right-handed golfers. To develop inserts for a set of left-handed clubs used by a left-handed golfer, the apertures for the wood clubs and other clubs would be placed on opposite sides of the bag, i.e., the pattern of apertures in the insert would be a mirror image of the inserts intended for use with right-handed clubs.

Figure 2:
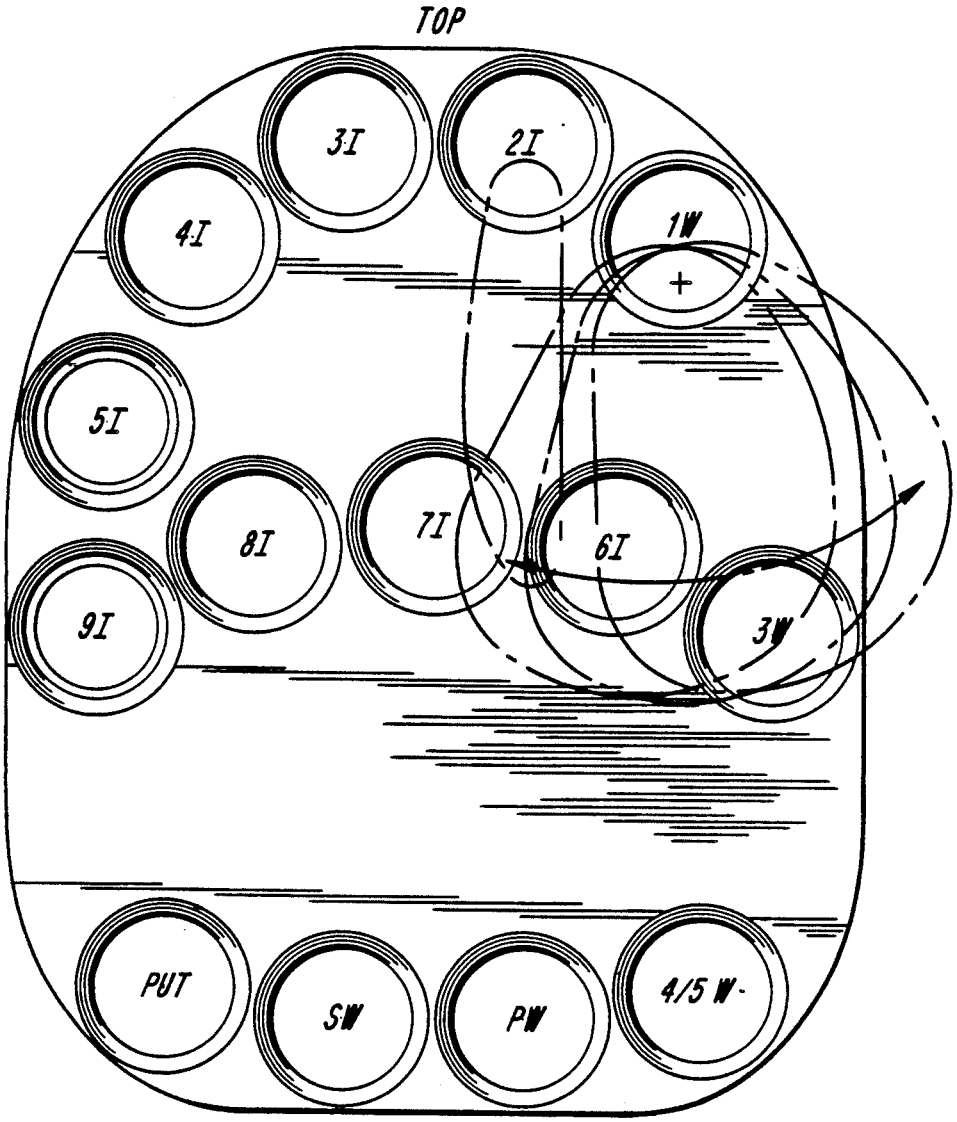
FIG. 2 is a top plan view of a preferred embodiment of the present invention as applied to a golf bag of substantially rectangular cross-section.

Referring now to FIG. 2, this process can be envisioned by considering the contours of the 1 wood or driver (1W) and the contour for the adjacent 2 iron (2I) which were superimposed on apertures with the clubs in their normal resting position with the shaft at the lowest point of the aperture. (The alphanumeric code indicates the numbers of the woods and irons.) The driver is shown in rotation through 15 degrees of arc in each direction while the 2 iron is at rest. Although all clubs will normally rotate in the same direction while the bag is in motion, even if these clubs could be expected to overlap slightly as they rotate during movement of the bag, the difference in lengths of shafts would preclude direct contact between the club heads. Thus, the apertures for the club shafts can be placed closer together when the adjacent clubs are of significantly different lengths, and more effective use can be made of the lateral space in the bag.

Professional golfers are limited to 14 clubs in tournament play, with a standard set normally including 3 or 4 wood clubs, 7 or 8 iron clubs numbered from 2 to 9, a putter and various miscellaneous clubs such as wedges for use on sand or in chipping, etc. For convenience in arranging the clubs within the bag as well as for convenience of play, the clubs can be grouped as woods, listed as first, second, third and fourth without reference to the actual numeral designator of the club; long irons, being the irons with the longest shafts, generally numbered from 2 through 4, mid-irons, being irons with somewhat shorter shafts and generally numbered from 4 or 5 through 7, and short irons, generally including the putter, 8 and 9 iron and miscellaneous wedges and the like.

Referring now to FIG. 1, depicting a pattern for an insert for a golf bag of circular cross-section to accommodate a standard set of 14 golf clubs, apertures for three wood clubs (in this case, the three, four and five woods) are contained in an arc extending along the right side of the insert, with an aperture for an additional wood or long iron at the top near the center line. The pattern is oriented to represent a plan view of an insert for a golf bag, with the bottom of the pattern representing the side normally attached to a golf cart. In FIGS. 1 and 2, the apertures are marked to indicate the clubs typically inserted, designated by alpha-numeric codes such as 1W for a one wood or driver, 3I for a three iron, etc. Such codes can also be marked on the insert near the apertures to aid the user or caddy in placing the clubs optimally. Such markings can be specific (e.g., 3W) or indicate alternatives, as in the 2I/IW shown. This indicates that if only three rather than four woods are used in the bag, a long iron such as a two iron can replace the one wood in this position, with the first, second and third woods being placed in the apertures marked 3W, 4W and 5W. Thus, the pattern can be laid out to accommodate variations in the sets of clubs used by different golfers, or even the same golfer on different courses. Apertures for two long irons, in this case a 3 and 4 iron, are located in the upper left quadrant of the pattern, along the periphery. Apertures for three shorter clubs, in this case including the putter, and two wedges, are provided in an arc extending along the lower portion of the pattern. An aperture for at least one short iron, e.g., the 9 iron (9I) is placed in the lower left quadrant of the pattern. Apertures for the remaining clubs, generally the mid-irons, e.g., irons 5 through 8, are arranged in a straight line extending horizontally across the center of the pattern approximately perpendicular to the center line, being spaced appropriately to avoid interference with each other or with clubs in adjacent positions.

Expressed in other words, in the pattern of FIG. 1, with the aperture for the first wood or long iron being located on the periphery of the pattern and approximately −5° of arc, the center line for the aperture for the second wood is located on the periphery of the pattern between about 35° and 41° of arc, with the center of the aperture for the third wood located also on the periphery of the plate at about 87° to 93° of arc and the center of an aperture for a third or fourth wood club located on the periphery of the pattern at about 134° to about 140° of arc.

The center for an aperture for a short iron or putter is located on the periphery of the plate at about 161° to 167° of arc, the center of the aperture for a short iron such as a sand wedge is located on the periphery of the pattern at about 185° to 191° of arc and the center of an aperture for another short iron such as a pitching wedge is located on the periphery of the pattern at about 208° to about 214° of arc. The center of an aperture for a short iron such as a 9 iron is located on the periphery of the plate at about 243° to about 249° of arc, and an aperture for a mid-iron such as a 4 iron is located on the periphery of the plate at about 296° to about 302° of arc, with the center of an aperture for a long iron such as a 3 iron located on the periphery of the pattern at about 326° to about 332° of arc.

Apertures for mid- or short irons such as the 5, 6, 7 and 8 irons are located sequentially along a horizontal line through the center roughly in line with the aperture for the third wood, in this case commencing nearest to the aperture for the 4 wood and extending horizontally toward the periphery of the bag between the apertures for the 9 iron and 4 iron. The apertures in this horizontal line are spaced appropriately to avoid interference between the individual club heads and between these club heads and heads of clubs in other groups.

This arrangement provides for convenient use of the golf clubs during normal play, grouping similar clubs in groups corresponding to the phases of play, at the same time providing maximum lateral and vertical separation between the club heads to preclude damage as they execute normal rotational and vertical movements while the bag is moved during a round of golf.

The insert can be made of any suitable material, including wood, light metal, resinous or elastomeric polymers, rubber, leather or cloth. The insert is preferably strong and rigid enough to help the bag retain its shape during normal handling, but not heavy enough to add significant weight to the bag. The inserts can be of solid construction, or made of material of open-work such as slots, mesh or perforated sheets, but preferably are solid to provide protection against rain or dust. Since even bags mass-produced to a specific pattern may vary somewhat in size and configuration, in a preferred embodiment the insert is made of an elastomeric material which can be compressed when inserted into the bag and thus exert pressure on all sides of the bag for a snug fit. Alternatively, a gasket or liner of elastomeric material can be included on the periphery of the insert to provide such a snug fit which assists the insert in remaining in position through friction and at the same time provides a seal which is reasonably water and dust tight. In addition to using a friction-tight fit, the inserts can be secured in the bag by various conventional mechanical means, including screws, pegs, nails, clips, brackets, latches and the like. Since many available golf bags include transverse bars near the top to separate the golf clubs into two or more groups, in designing inserts to fit such bags the underside of the upper insert can be grooved to fit over such bars, thus using them as a support. The apertures are preferably countersunk on the upper surface of the insert to receive bushings, sleeves, or tubes to guide and receive the club handles, as shown in FIGS. 1 and 2. In FIG. 1, the apertures for the sand wedge and putter at bottom are shown with such tubes installed. The tubes can have a lip or flange which fits the countersunk area. In FIG. 2, the tubes are shown as installed in the apertures for the 5 and 9 irons, at left. Each aperture can be fitted with a bushing or sleeve of elastomeric material which will usually accommodate the insertion and removal of the club shaft and handle but will fit relatively snugly about the shaft while the clubs are inserted to reduce the possibility of the entry of water, dust or dirt. Such bushings or sleeves can also be used to restrict the rotational and vertical movement of clubs while the bag is handled, reducing the clearance required between apertures.

Although a single such insert at or near the top of the bag is sufficient to position most sets of clubs, the system preferably includes at least one additional insert at or near the bottom of the bag to receive the handles of the clubs, thus retaining them firmly in position and preventing contact between the handles and shafts of individual clubs. Such an additional insert further provides additional shaping support to the bag. Since it may be difficult to insert the handle of a club into a second insert located below the first insert, such a system preferably includes a set of protective tubes for the handles and shafts of the clubs, e.g., the plastic protective tubes known in the industry, with a tube passing through the corresponding apertures of the plates, thus providing a unified structure and a protective channel for each club shaft and handle. When such tubes are used, the apertures in the upper insert are generally countersunk or recessed to accommodate a flange or rim at the upper ends of the tubes.

Referring now to FIG. 2, an embodiment designed for a golf bag of substantially rectangular cross-section is disclosed. Examining this plan view as in FIG. 1 with the side of the bag normally connected to a cart at the bottom, apertures for three wood type clubs are located along the periphery of the insert on the right side. Apertures for long and mid-irons are located in an arc extending from the top of the insert into the upper left quadrant; in this case irons of numbers 2, 3, 4 and 5 are provided for. A second group of apertures are located in a row or in an arc-like pattern beginning adjacent to the aperture position for the second wood and extending across the insert to the left and toward the lower left quadrant, providing for a group of short irons, numbers 6, 7, 8 and 9 in this case. A group of three apertures is located along the bottom edge of the insert for the putter and miscellaneous irons such as a sand or pitching wedge. The locations of these coordinates could of course be described by the angular coordinate system used above with the insert for a circular bag. These apertures have been positioned to minimize interference between the club heads, rather than placing them in simple geometric patterns or lines of equal spacing. Positions are provided for a complete standard set of 14 clubs including pitching wedge and sand wedge here, but a similar pattern could be devised for fewer or more clubs, or to provide for variations within a standard set of 14, as, e.g., providing woods number 1, 2 and 3 rather than 1, 3 and 4 or 5. As in FIG. 1, the apertures for the various clubs are placed so that the clubs can be conveniently removed and replaced in the approximate order in which they are used during a round of play.

It should be understood that various changes in the details, materials, arrangements of parts and operating conditions which have been herein described and illustrated to explain the nature of the invention may be made by those skilled in the art within the principles and scope of the invention. For instance, the process of the invention can be used to design a club-separating insert system which will maximize the effective separation between club heads for any set of clubs, standard or non-standard, to fit into a golf bag of any suitable size and shape. Computer-assisted methods can be used to determine the characteristics of the clubs and to carry out steps in the design process such as are described in the hand method discussed above.

I claim:

1. A process of designing and producing a club-separating insert system for a golf bag to arrange a set of golf clubs in a pattern of groups convenient for normal play and to provide maximum effective clearance between the heads of said clubs when inserted in said bag, comprising the steps of:

(a) projecting the plan view contour of each club head onto a horizontal plane and determining the locus of maximum expected rotation movement of each said contour in a horizontal plane when said clubs are inserted vertically into suitable apertures, (b) determining the vertical height of each club head from the end of the club handle, (c) preparing at least one insert for said golf bag containing a plurality of apertures for each golf club of the set, said apertures being positioned in groups and spaced within groups at intervals, at least some of which non-uniform, so as to maximize the effective clearance between the club heads while said golf bag is in use, as determined by the lateral and vertical separation between said club heads and the rotational and vertical motion of said club heads while said golf bag is in use, and to group together the types of clubs most often used in each phase of play.

2. A club-separating insert system for a golf bag comprising an upper insert to fit inside the top of said golf bag, said insert having a plurality of apertures to receive the handles and shafts of a set of golf clubs, said apertures being arranged in groups for the storage of said clubs in a pattern convenient for normal play, wherein said apertures for the types of clubs most often used in each phase of play are grouped together, and spaced within groups at intervals, at least some of which are nonuniform, to maximize the effective clearance between the heads of said clubs while said golf bag is in use, as determined by the lateral and vertical separation between said club heads and the rotation and vertical motion of said club heads while said golf bag is in use, wherein said upper insert is a circular insert containing apertures located on the periphery of the insert by degrees of arc from the upper center line of said circular insert, the first wood club being at about −5° arc, with the second wood located at about 35° to about 41° of arc, the third wood located at about 87° to about 93° of the arc and the aperture for the fourth wood located about 134° to about 140° of arc, with an aperture for a putter located at about 161° to about 167° of arc, an aperture for a first wedge club located at about 185° to about 191° of arc, an aperture for a second wedge club located at about 208° to about 214° of arc, an aperture for a short iron located at about 243° to about 249° of arc, an aperture for along or mid-iron located at about 296° to about 302° of arc, and an aperture for a long iron located at about 326° to about 332° or arc, and having apertures for four mid to short irons located in a row extending horizontally through the center of said insert.

3. An insert system in accordance with claim 2, providing apertures for a standard set of 14 golf clubs.

4. An insert system in accordance with claim 2, further comprising a second insert to fit inside said bag at or near the bottom, having a corresponding plurality of apertures for the handles of said golf clubs, said inserts being connected together by a plurality of tubes connecting the corresponding apertures and fitted to receive the handles and shafts of the golf clubs.

5. An insert system for a golf bag comprising an upper insert to fit inside the top of said golf bag, said insert having a plurality of apertures to receive the handles and shafts of a set of golf clubs, said apertures being arranged in groups for the storage of said clubs in a pattern convenient for normal play, wherein said apertures for the types of clubs most often used in each phase of play are grouped together, and spaced within groups at intervals, at least some of which are nonuniform, to maximize the effective clearance between the heads of said clubs while said golf bag is in use, as determined by the lateral and vertical separation between said club heads and the rotation and vertical motion of said club heads while said golf bag is in use, wherein said upper insert is of substantially rectangular cross section and viewing said upper insert in plan view from the side normally attached to a pull cart, said insert contains apertures for at least three wood clubs along the periphery on its right side, apertures for about three long irons along the periphery at the top of said insert, an aperture for one mid-iron at the left side of said insert adjacent to the apertures for said long irons, apertures for at least one short iron below said aperture for said mid-iron on the left side of said insert, and a row of at least three apertures for mid-irons extending across the center of said insert in a line approximately perpendicular to the center line, with apertures for a putter and at least one wedge type club along the bottom periphery of said insert, and further comprising a second insert to fit inside said bag at or near the bottom, having a corresponding plurality of apertures for the handles of said golf clubs, said inserts being connected together by a plurality of tubes connecting the corresponding apertures and fitted to receive the handles and shafts of the golf clubs.

6. An insert system in accordance with claim 5, providing apertures for a standard set of 14 golf clubs.

7. A club-separating insert system for a golf bag comprising an upper insert to fit inside the top of said golf bag, said insert having a plurality of apertures to receive the handles and shafts of a set of golf clubs, said apertures being arranged in groups for the storage of said clubs in a pattern convenient for normal play, wherein said apertures for the types of clubs most often used in each phase of play are grouped together, and spaced within groups at intervals, at least some of which are non-uniform, to maximize the effective clearance between the heads of said clubs while said golf bag is in use, as determined by the lateral and vertical separation between said club heads and the rotational and vertical motion of said club heads while said golf bag is use, wherein said upper insert is of substantially rectangular cross section and viewing said upper insert in plan view from the side normally attached to a pull cart, said insert contains apertures for at least three wood clubs along the periphery on its right side, apertures for about three long irons along the periphery at the top of said insert, an aperture for one mid-iron at the left side of said insert adjacent to the apertures for said long irons, apertures for at least one short iron below said aperture for said mid-iron on the left side of said insert, and a row of at least three apertures for mid-irons extending across the center of said insert in a line approximately perpendicular to the center line, with apertures for a putter and at least one wedge-type club along the bottom periphery of said insert.

* * * * *